US005183347A

United States Patent [19]

Higuchi et al.

[11] Patent Number: 5,183,347

[45] Date of Patent: Feb. 2, 1993

[54] APPARATUS FOR PRINTING IMAGES ON BOOKLETS

[75] Inventors: Kazuhiko Higuchi, Kawasaki; Shuzo Hirahara; Tutomu Saito, both of Yokohama; Hitoshi Nagato, Kawasaki; Akito Iwamoto, Kamakura, all of Japan

[73] Assignee: Kabushiki Kaisha Toshiba, Kawasaki, Japan

[21] Appl. No.: 920,528

[22] Filed: Jul. 28, 1992

Related U.S. Application Data

[63] Continuation of Ser. No. 627,592, Dec. 14, 1990, abandoned.

[30] Foreign Application Priority Data

Dec. 15, 1989 [JP] Japan ..... 1-323929

[51] Int. Cl.[5] ..... B41J 11/42

[52] U.S. Cl. ..... 400/583.3; 271/185; 400/26; 400/25; 400/649

[58] Field of Search ..... 400/24-28, 400/121, 583.3, 645, 649, 582; 235/472; 271/1, 25, 184-186; 281/6-9, 42; 283/57-64.1; 40/475, 530, 531; 101/269

[56] References Cited

U.S. PATENT DOCUMENTS

| | | | |
|---|---|---|---|
| 953,875 | 4/1910 | Waring | 400/26 |
| 3,868,008 | 2/1975 | Brumbaugh | 400/26 |
| 3,892,427 | 7/1975 | Kraynak et al. | 270/1 |
| 3,982,744 | 9/1976 | Kraynak et al. | 270/12 |
| 4,395,031 | 7/1983 | Gruber et al. | 270/54 |
| 4,516,866 | 5/1985 | Yamauchi | 400/25 |
| 4,593,407 | 6/1986 | Konishi et al. | 382/46 |
| 4,700,497 | 10/1987 | Sato et al. | 40/475 |
| 4,743,129 | 5/1988 | Keryhuel et al. | 400/583.3 |
| 4,848,231 | 7/1989 | Stienstra | 101/490 |
| 4,852,487 | 8/1989 | Stienstra | 101/232 |

FOREIGN PATENT DOCUMENTS

| | | | |
|---|---|---|---|
| 0313085 | 4/1989 | European Pat. Off. . | |
| 150592 | 9/1982 | Japan | 400/25 |
| 181872 | 11/1982 | Japan | 400/719 |
| 66658 | 5/1986 | Japan | 400/121 |
| 6124750 | 6/1986 | Japan . | |
| 270356 | 11/1987 | Japan | 400/616.2 |
| 2002291 | 2/1979 | United Kingdom . | |

OTHER PUBLICATIONS

IBM Technical Disclosure Bulletin, "Passbook Clamping Mechanism for a Rotary Feed Drum", Hama and Tsukamoto, vol. 27, No. 6, Nov. 1987.

IBM Technical Disclosure Bulletin, "Passbook Printing Improvement," vol. 29, No. 6 Nov. 1986, pp. 2724-2725.

IBM Technical Disclosure Bulletin, "Springloaded Floating Platen Assembly" Cole and Dombrowski, vol. 20, No. 6, Nov. 1977, pp. 2366-2367.

*Primary Examiner*—Edgar S. Burr
*Assistant Examiner*—Christopher A. Bennett
*Attorney, Agent, or Firm*—Oblon, Spivak, McClelland, Maier & Neustadt

[57] ABSTRACT

An apparatus for printing images on a booklet comprises, first and second paired pinch rollers for conveying pages of the opened booklet to a printing head, located between these paired pinch rollers, a rotatable platen opposed to the printing head and located between the paired pinch rollers, guide plate for guiding one page of the opened booklet to the platen, and a press member for fixing the free end of the one page to the platen. The second paired rollers hold the other page of the booklet but may slipe the page when the free end of the one page is fixed onto the platen thereby adding tension to the other page of the booklet as the platen is rotated. The layout of the recorded images are changed and then printed on the page.

9 Claims, 15 Drawing Sheets

COLUMN ADDRESS

| LINE ADDRESS | 1 | 2 | 3 | 4 | 5 | 6 | 7 | 8 | 9 | 10 |
|---|---|---|---|---|---|---|---|---|---|---|
| 1 | 1 | 2 | 3 | 4 | - | - | - | - | 9 | 10 |
| 2 | 11 | 12 | - | - | - | - | - | - | - | - |
| 3 | - | - | - | - | - | - | - | - | - | - |
| 4 | - | - | - | - | - | - | - | - | - | - |
| 5 | - | - | - | - | - | - | - | - | - | - |
| 6 | - | - | - | - | - | - | - | - | - | - |
| 7 | 61 | - | - | - | - | - | - | - | - | - |
| 8 | 71 | 72 | 73 | - | - | - | - | - | 79 | 80 |

FIG. 8

ADDRESS

| 1 | 2 | 3 | 4 | 5 | 6 | 7 | 8 | 9 | 10 |
|---|---|---|---|---|---|---|---|---|---|
| 1 | 2 | 3 | 4 | 5 | 6 | 7 | 8 | 9 | 10 |

FIG. 9

| OUTPUT DIRECTION OF DATA | IMAGE RECORDED FACE MADE VISIBLE | RECORDING FROM "TOP" TO " BOTTOM" | RECORDING FROM "BOTTOM" TO " TOP" |
|---|---|---|---|
| LEFT TO RIGHT | REFLECTION | — | INVERTED-IMAGE-CONVERSION |
| RIGHT TO LEFT | REFLECTION | IMAGE-CONVERSION | IMAGE-INVERSION |
| LEFT TO RIGHT | PENETRATION | IMAGE-INVERSION | IMAGE-CONVERSION |
| RIGHT TO LEFT | PENETRATION | INVERTED-IMAGE-CONVERSION | — |

FIG. 16

DIRECTION IN WHICH BOOKLET IS INSERTED AND PRINTED LINES ARE DETECTED

APPARATUS FOR PRINTING IMAGES ON BOOKLETS

This application is a continuation of application Ser. No. 07/627,592, filed on Dec. 14, 1990, now abandoned.

BACKGROUND OF THE INVENTION

1. Field of the Invention

The present invention relates to an apparatus for printing images on booklets or books such as a passbook and the note and, more particularly, it relates to an apparatus for printing images on booklets and enabling the booklets to be more easily treated.

2. Description of the Related Art

In the conventional case of printing images on booklets, the top or bottom of the booklet had to be directed in a predetermined direction when the booklet was inserted into the apparatus, thereby making it hesitative to insert the booklet into the apparatus.

The image in high tone or full color is recorded using three primary color inks of yellow, magenta and cyanogen (or four color inks further including black) and successively piling these inks one by one. It was difficult to record these color inks several times on the page of a booklet such as a passbook and the note, and any of the images in high tone or full color was not recorded on the booklet accordingly. Further, in order to record images near to the seam of the booklet, the booklet must be opened to the fullest and when such a booklet that had too many pages was opened to the fullest, the seam portion of the booklet was often damaged.

SUMMARY OF THE INVENTION

The object of the present invention is therefore to provide an apparatus for printing images on booklets and enabling the booklets to be more easily inserted into the apparatus without feeling any hesitation, images in full color to be recorded on pages of the booklets with a higher accuracy and the images to be recorded on the pages of the booklets until the printing of these images comes near to seams of the booklets without adding any damage to the booklets, when the images are to be recorded on the pages of the booklets such as the passbook and the note.

According to the present invention, the layout of images to be recorded is changed depending upon whether the top or bottom of a predetermined page or booklet is inserted ahead into the apparatus when the images are to be recorded on the page of the booklet. More specifically, the apparatus includes at least one of those means which serve to invert the images to be recorded, convert the images rightside left, that is, make mirror images, and change the arrangement of column and row images, that is rotate the images by 90°. For example, when the images are to be recorded on a page of the booklet from the "bottom" of the page to the "top" thereof, the images are processed to inverted images, subjected to the image-by-conversion process, depending upon the arrangement of the apparatus and the use of images recorded pages of the booklet, so as to align the top and bottom of the recorded images with those of the booklet.

The apparatus of the present invention includes at least one of the inverted images and images-by-conversion processing and vertical-to-traverse converting means, as described above. When images are to be recorded on a predetermined page of the booklet, therefore, the printing of the images can be made on the page of the booklet from the "top" of the page to the "bottom" thereof and vice versa, thereby making it easier to insert the booklets into the apparatus without feeling any hesitation.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 8 and 9 are intended to explain the operation of a buffer memory;

FIG. 16 is a view showing how the booklet is treated; and

DETAILED DESCRIPTION OF THE PREFERRED EMBODIMENT

Figure 1:
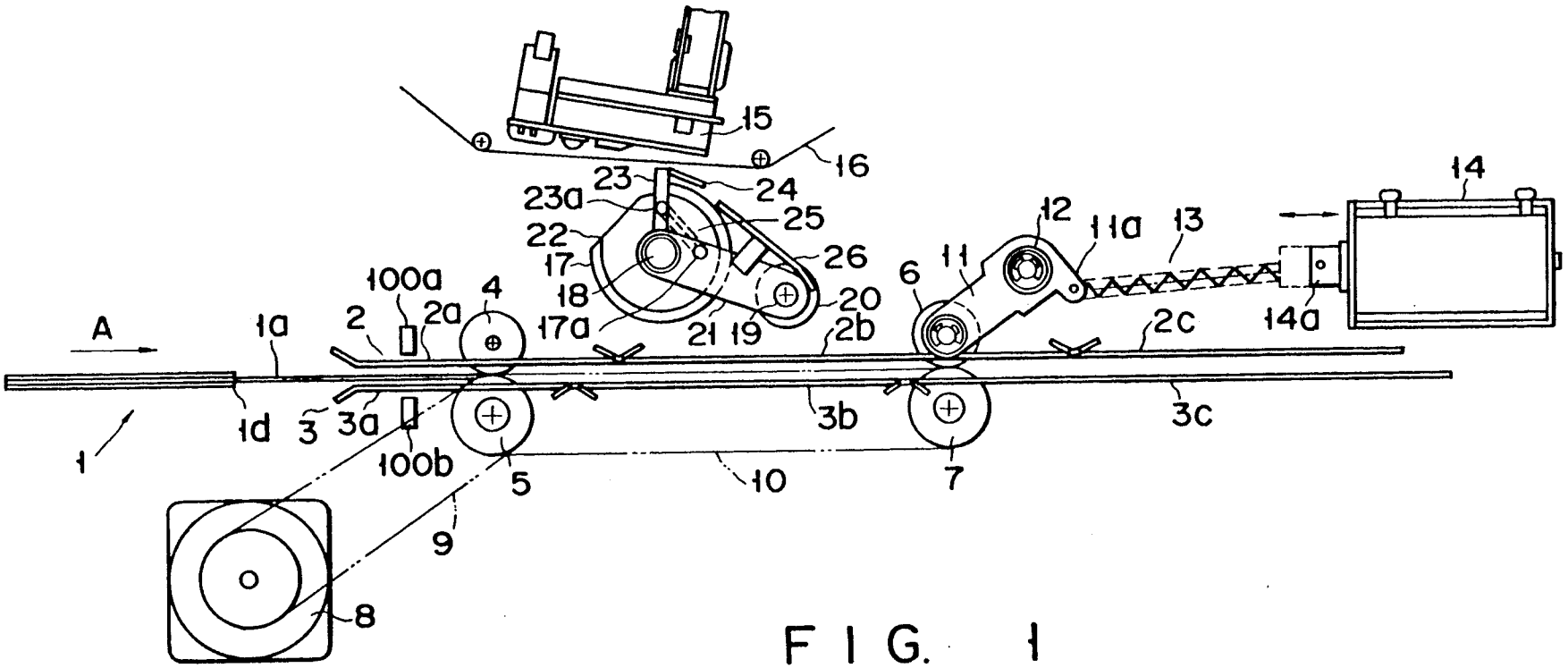
FIGS. 1 through 5 are views showing the arrangement of systems of the apparatus for printing images on booklets according to one embodiment of the present invention.

An embodiment of the present invention will be described in detail with reference to the accompanying drawings.

FIGS. 1 through 5 show the arrangement of main systems and how they are operated in the apparatus for printing images on booklets according to the present invention. FIG. 6 is a block diagram showing the arrangement of a section for processing images and layouts.

A booklet or book 1 (such as the book, note and passbook) is conveyed through systems of the apparatus in a direction A, while keeping its seam line 1*d* perpendicular to the direction A and its cover 1*a* open. Upper and lower guides 2 and 3 each of which comprises plural guide members are arranged along the conveying direction of the booklet 1, having between them an interval a little larger than the thickness of the booklet 1. A conveying path is formed between these upper and lower guides 2 and 3 and the booklet 1 is conveyed along the conveying path between the upper and the lower guides. Upper and lower inlet rollers 4 and 5 are located at a certain position on the conveying path, contacting each other between the upper and the lower guides, while upper and lower outlet rollers 6 and 7 are also located at another certain position on the conveying path, contacting each other between the upper and the lower guides. The interval between the inlet rollers 4, 5 and the outlet rollers 6, 7 is set smaller than the length of the open booklet 1 in the conveying direction. The rollers 5 and 7 are rotated forward and backward by a reversible motor 8. The rotation force of the reversible motor 8 is transmitted to the rollers 5 and 7 by belts 9 and 10 which are stretched between the motor 8 and the roller 5 and between the roller 5 and the roller 7, respectively. According to this embodiment, the rollers 5 and 7 are the same in diameter and they are therefore rotated at the same speed. The follower rollers 4 and 6 are contacted with the drive rollers 5 and 7, respectively, with a certain pressure but each of them has no independent drive source and they are rotated by associating with the rollers 5 and 7. The roller 6 which is contacted with the roller 7 is rotatably held by the free end of an arm member 11, whose base end is supported by the apparatus body (not shown) so as to swing around a shaft 12. One end of a tension coil spring 13 is connected to a further end 11*a* of the arm 11 which is projected from the base end of the member 11, while the other end of the tension coil spring 13 is connected to a direct-acting rod 14*a* of a direct-acting actuator 14. When the actuator 14 is driven, the direct-acting rod 14*a* is reciprocated as shown by arrows to swing the arm member 11 around the shaft 12 through the tension coil spring 13. The force with which the follower roller 6 is pressed against the drive roller 7 can be thus changed. When the actuator 14 is not driven with its direct-acting rod 14*a* retreated, however, the roller 6 is lightly contacted with the roller 7.

A printer system is located above middle guide members 2*b* and 3*b*. The upper guide member 2*b* is supported by the apparatus body in such a way that it can slide in the longitudinal direction thereof to open the upper side of the conveying path, and the lower guide member 3*b* is also supported by the apparatus body in such a way that it can swing around its right end to open the underside of the conveying path. A recording head 15 is of the heat-sensitive thermal type intended to add heat to an ink ribbon 16 to carry out the heat transfer printing. The ink ribbon 16 includes three primary colors of yellow, magenta and cyanogen (which will be referred to as YMC), for example, and further black, if necessary, to carry out letter printing and color image printing. A platen 17 is rotatably supported by the apparatus body, opposing to the head 15, with the ink ribbon 16 interposed between them. The platen 17 is rotated around a shaft 18 by an actuator (not shown). A roller 20 which can be rotated by a drive source (not shown), independently of the platen 17, is located adjacent to the platen 17 and both of these roller 20 and platen 17 are connected to each other by an arm plate 21 to keep the interval between their rotation centers 18 and 19 certain. The arm 21 is supported by the apparatus body to rotate around the rotation shaft 18. The peripheral surface of the roller 20 is made of a material which has a large friction coefficient. As shown in FIG. 1, a part of the outer circumference of the platen 17 is cut away to form a flat face 22 and when it is viewed from its side, therefore, its profile consists of a partial circle and a straight line. A holding plate 23 which can rotate around the rotation shaft 18 is attached to one end face of the platen 17. A member (or rubber, for example) 24 having a large friction coefficient is fixed to that portion of the holder 2 which extends from the free end of the plate 23 at an angle of 90° and which faces the outer circumference of the platen 17. A tension spring 25 is stretched between a protrusion 17*a* on the side face of the platen 17 and another protrusion 23 on the holder 23. The holder 23 is urged by the tension spring 25 to contact the friction member 24 with the outer circumference of the platen 17. When printing is not carried out, however, the member 24 is held separated from the outer circumference of the platen 17 by means of a cam or pin (not shown). A guide plate 26 is arranged to linearly connect the outer circumferences of the platen 17 and roller 20 (or to substantially align with the tangential lines of them). The guide plate 26 is fixed to the arm 21.

The above-described components of the apparatus are made operative by various sensors (not shown) in the apparatus and responsive to the booklet 1 conveyed.

The operation of the apparatus which has the above-described arrangement will now be described.

The booklet 1 is conveyed at first. As shown in FIG. 1, the open booklet 1 which has been conveyed through various systems (not shown) is positioned left in FIG. 1 to be conveyed in the direction A. The front rim of the cover 1*a* which corresponds to a right page of the booklet 1 is sandwiched between the rollers 4 and 5 and when the roller 5 is rotated clockwise by the motor 8, the conveying of the booklet 1 is started in the direction A. The booklet 1 moves between the forward guide members 2*a* and 3*a* and then between the middle guide members 2*b* and 3*b*, using the space between the guides 2 and 3 as its conveying path. Before the rear rim of a left page 1*b* of the booklet 1 (which is opposed to the seam line 1*d* of the booklet 1) reaches between the inlet rollers 4 and 5, the front rim of the right page of the booklet 1 is held between the outlet rollers 6 and 7 and the conveying of the booklet 1 is continued. When the booklet 1 is under such a state as shown in FIG. 1, the pulling force of the spring 13 created by the actuator 14 is controlled in such a way that the force with which the outlet rollers 6 and 7 are contacted with the booklet 1 becomes equal to the force with which the inlet rollers 4 and 5 are contacted with the booklet 1.

Figure 2:
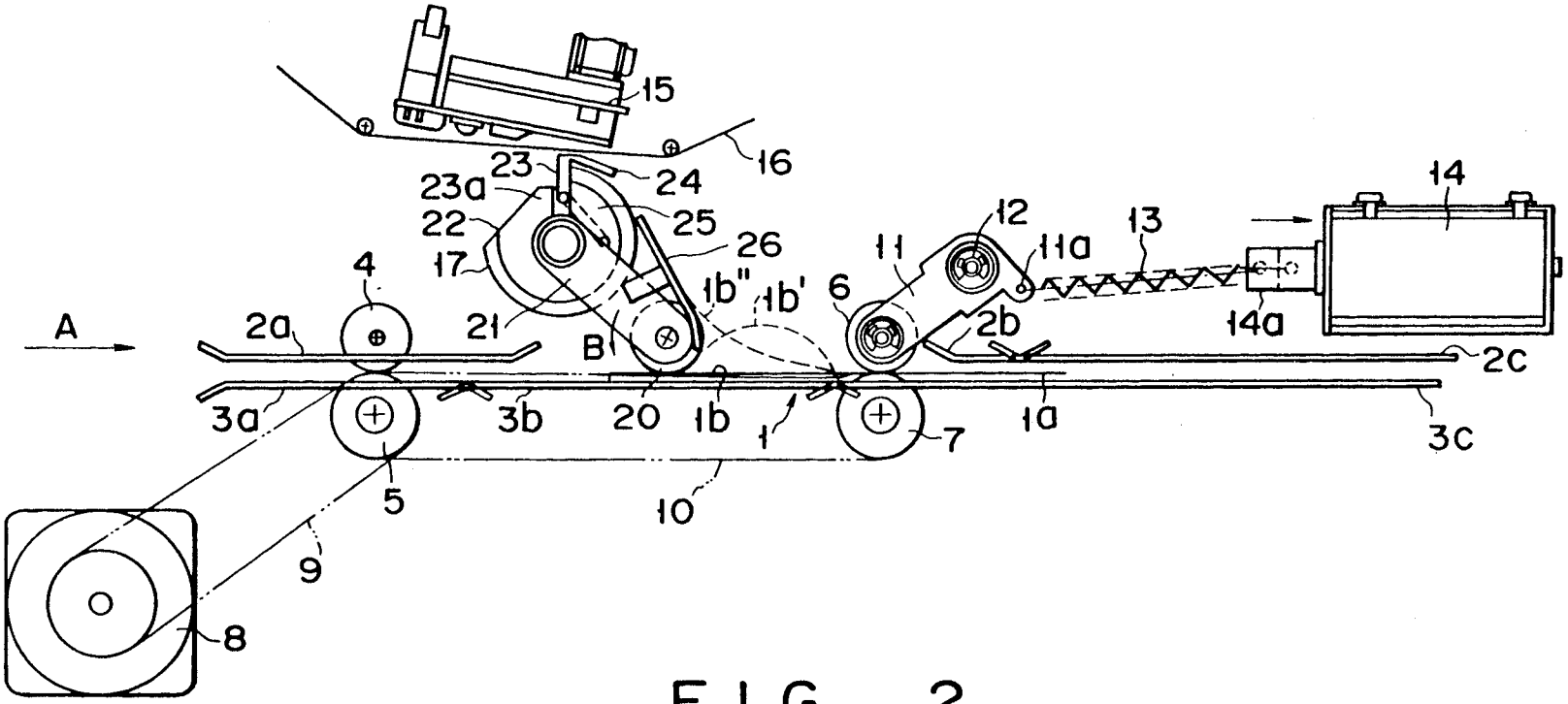
Figure 3:
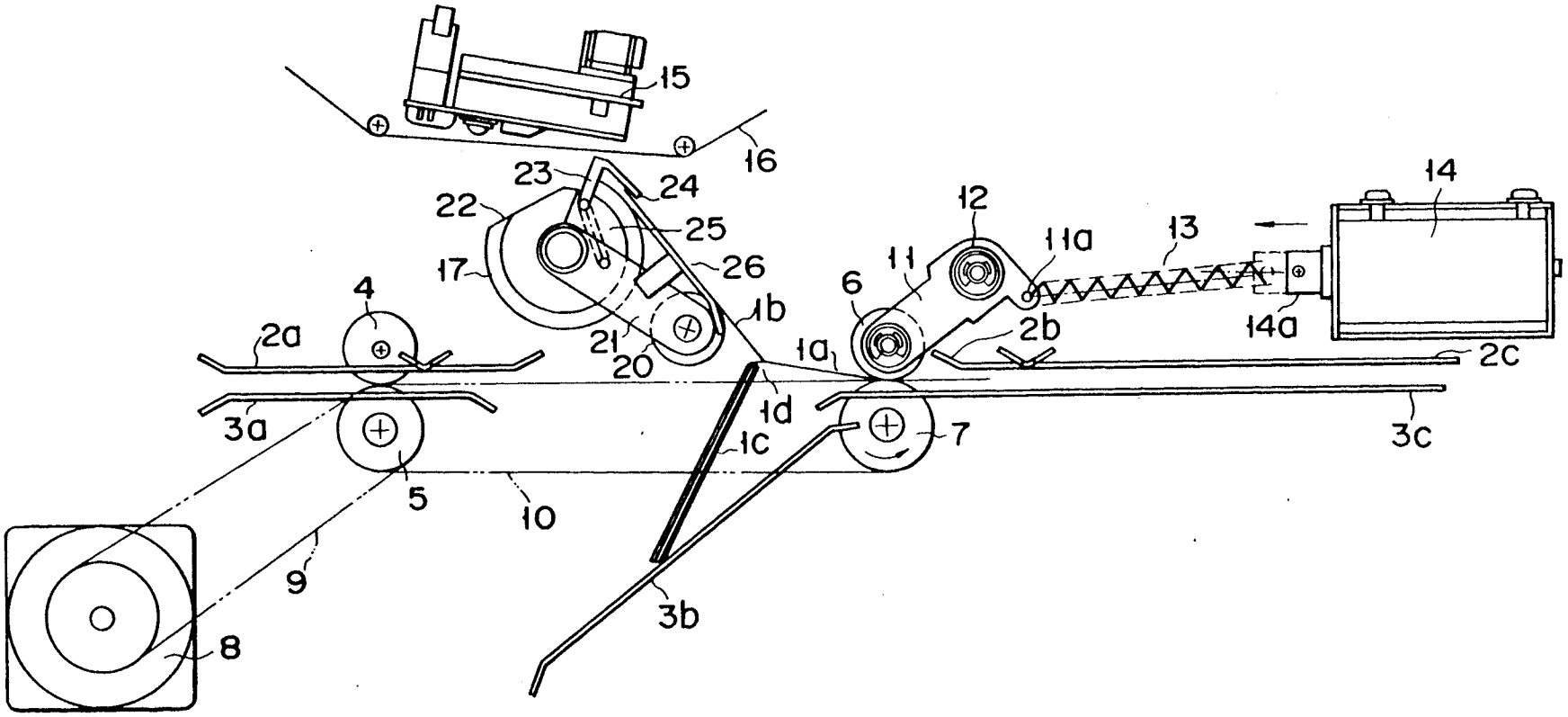

The operation of turning over the page of the booklet 1 is then started. When the booklet 1 is released between the inlet rollers 4 and 5 and the seam 1*d* of the booklet 1 comes near to the outlet rollers 6 and 7, as shown in FIG. 2, a stop signal is applied to the motor 8 to stop the conveying of the booklet 1. The rollers 6 and 7 press-contact and fix the cover 1*a* of the booklet 1 at this time to keep the booklet 1 not moved. After this state is established, the upper guide member 2*b* retreats in the direction A to open the upper side of the conveying path and the arm 21 rotates clockwise to lower the roller 20, which is thus contacted with the left page 1*b* of the booklet 1. The roller 20 adds sufficient contact force to the left page 1*b* on the lower guide member 3*b*. The roller 20 is rotated in a direction B in FIG. 2 by its drive source and the left page 1*b* is thus turned over (as shown by 1*b*′ in FIG. 2). When the rear rim of the left page 1*b* is put on the guide plate 26 (as shown by 1*b*″ in FIG. 2), the guide member 3*b* is swung around its right end to retreat downward (as shown in FIG. 3), thereby preventing a second page and its following pages from being turned over. The left page 1*b* is thus kept floating, with its rear end mounted on the guide plate 26. The rotation of the roller 20 is stopped to control the second page and its following pages not to be turned over.

The process of holding the page 1*b* of the booklet 1 on the platen 17 is then started. After the left page 1*b* is put under such a state as shown by a broken line 1*b'* in FIG. 2, the rollers 7 and 20 are rotated in the reverse direction (or anticlockwise as shown by an arrow in FIG. 3) to move the booklet 1 in a direction reverse to the direction A. The roller 20 may be left not rotated in this case. The left page 1*b* is thus fed upward on the guide plate 26 and its rear rim reaches the surface of the platen 17. When the rear rim of the left page 1*b* is fed near to the press member 24, the cam or pin (not shown) is released allowing the holder 23 to be pulled by the spring to press and fix the rear rim of the left page 1*b* on the platen 17. Because the guide member 3*b* is retreated downward as described above, the booklet 1 is supported on the guide member 3*b* in such a way that its front cover 1*a* is held between the outlet rollers 6 and 7, that its left page 1*b* is held by the platen 17 and the holder 23, and that its other pages including its back cover 1*c* are hung, as shown in FIG. 3. The motor 8 is stopped under this state. The platen 17 is rotated anticlockwise when or before the left page 1*b* of the booklet 1 is pressed onto the platen 17.

The process of printing images on the left page 1*b* of the booklet 1 is then started. After the left page 1*b* is held by the holder 23, the guide plate 26 is swung a little clockwise around the rotation shaft 18 by the actuator (not shown) which serves to swing the arm 21 to thereby retreat the roller 20 near the guide member 2*a*. A control signal is applied to the actuator 14 at the same time and the direct-acting rod 14*a* is extended. The force with which the follower roller 6 is pressed against the drive roller 7 is thus little reduced, while the motor 8 is rotated to rotate the drive roller 7 clockwise (or in a direction reverse to the direction shown by the arrow in FIG. 3). As the result, the booklet 1 the rear rim of the left page 1*b* of which is sandwiched between the platen 17 and the press member 24 is fed by the rotating platen 17 while slipping its right page or front cover 1*a* between the rollers 7 and 6. Namely, tension is added to the left and right pages in reverse directions, allowing both of them to form a same plane. While keeping both of them under this state, the platen 17 is further rotated in a direction C (in FIG. 4) and printing is applied to the left page 1*b*. The head 15 presses the ink ribbon 16 against the left page 1*b* of the booklet 1 during the printing process and the YMC are scanned three times one by one to print images and others on the left page 1*b* of the booklet 1. Needless to say, the YMC can be scanned one time to achieve the printing.

Figure 5:
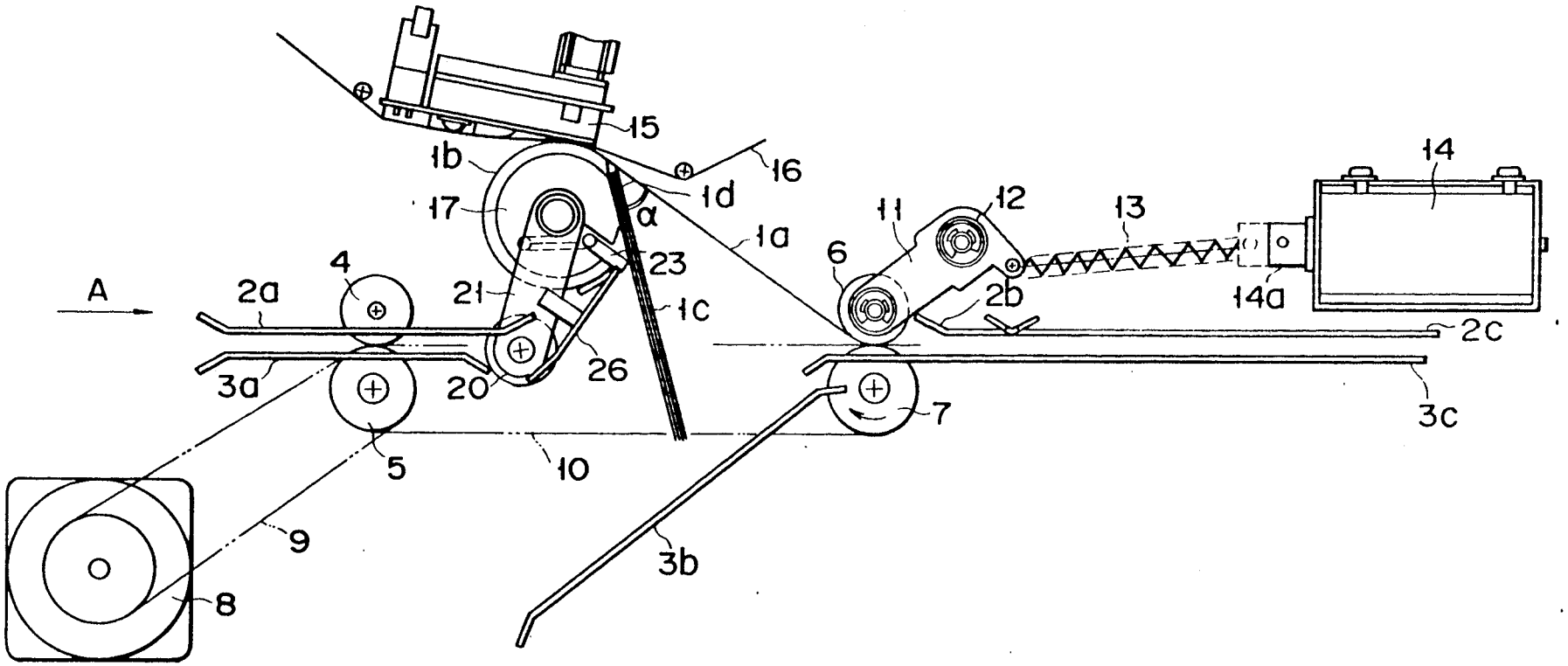
Figure 6:
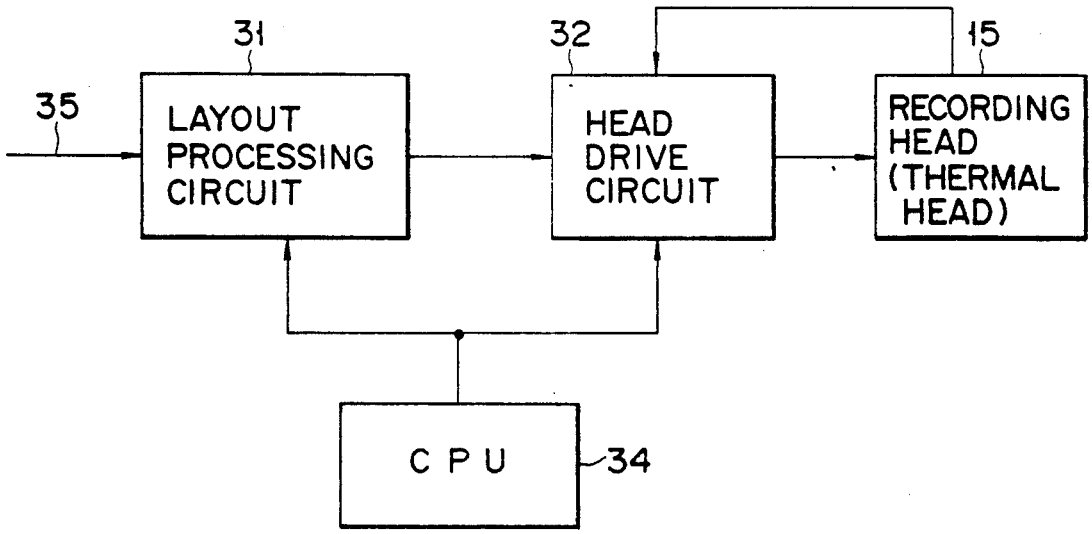
FIG. 6 is a block diagram showing an image processing section.

When the left page 1*b* is sufficiently wound around the platen 17 and the printing process advances near to the seam 1*d* of the booklet 1, this booklet 1 is put under such a state as shown in FIG. 5. In short, the seam 1*d* of the booklet 1 comes to the starting end of the cut-away face 22 of the platen 17, allowing the back cover 1*c* of the booklet 1 to face the front cover 1*a* thereof at a certain angle ($=\alpha°$) due to the cut-away face 22 formed on the platen 17.

When the printing process relative to the left page 1*b* is finished in this manner, the systems of the apparatus are controlled to carry out operations reverse to those done in the above and the booklet 1 is returned to the state shown in FIG. 2. When the motor 8 is again driven to rotate the roller 7, the booklet 1 is conveyed to a next section where a next process is applied to it. In a case where printing is to be applied to a next page of the booklet 1, the arm 21 in FIG. 2 is swung to lift the roller 20 to such a position that no pressure is added to the booklet 1 by the roller 20. The motor 8 is driven at the same time to rotate the roller 7 anticlockwise and the booklet 1 is thus moved in the direction reverse to the direction A while leaving the left page 1*b* under the state shown by 1*b''* in FIG. 2. Because the rear rim of the left page 1*b* is on the guide plate 26, it is turned over to right side at the time when the seam 1*d* of the booklet 1 passes over the roller 20. The left page 1*b* is thus opened to the right side of the booklet 1. The roller 7 is again rotated in the reverse direction to move the booklet 1 in the direction A and keep it under the state shown in FIG. 2. The process of turning over a next page of the booklet and printing images on it can be thus made ready.

Figure 4:
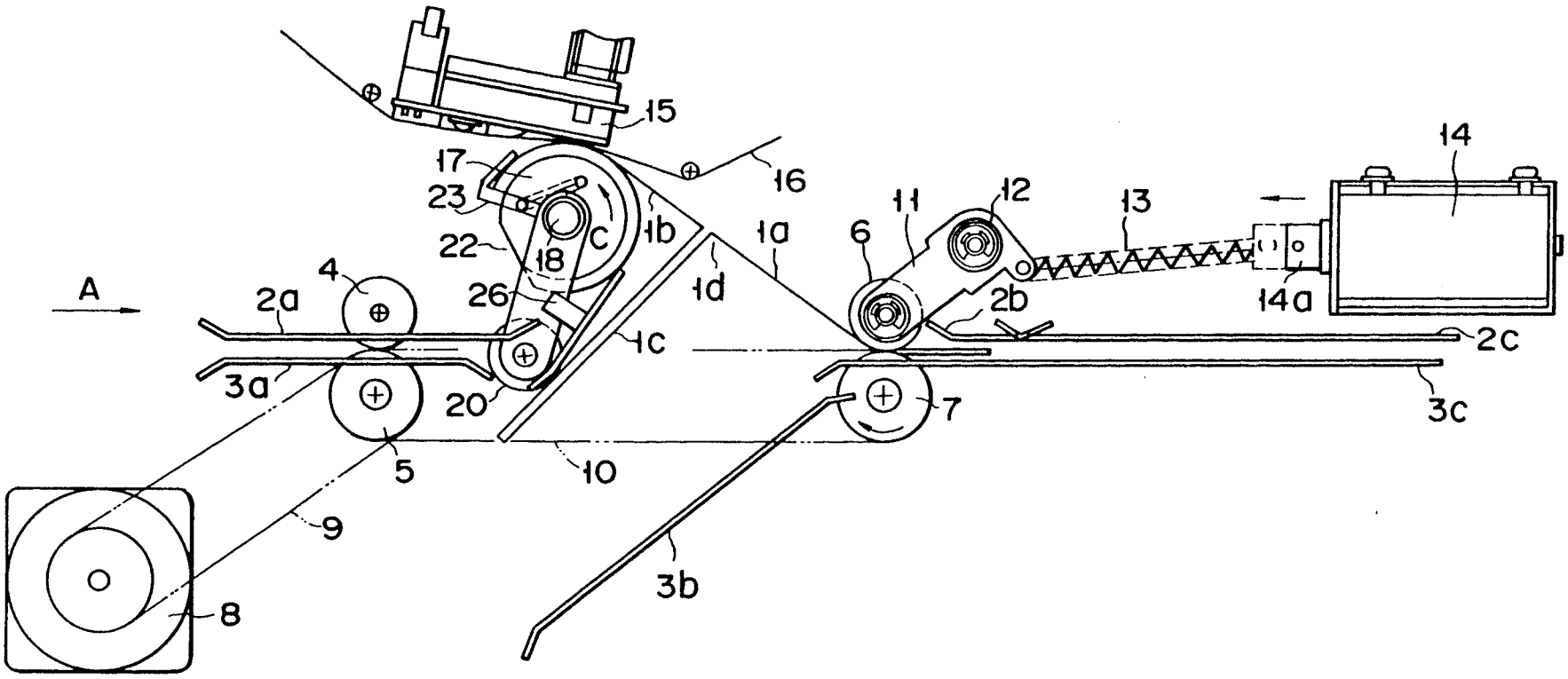

In a case where plural printings are to be applied to paper at a certain position thereof, it is needed that the paper is scanned plural times by the head. This creates the possibility that a shear in printing is caused because the printed paper is often slipped relative to the head. A measure of preventing the shear in printing is to add sufficient forward and backward tensions to the printed paper so as to press the printed paper against the platen on the conveying line with uniform force. According to the embodiment, attention is paid to the fact that sheets of printed papers are bound as a booklet, and there is therefore employed a manner of allowing the printed page to be pressed against the platen with uniform force on the conveying line without adding sufficient tension directly to the page on which images and others are to be printed. In short, the booklet comprises binding its pages as a unit along a seam line. When tension is added to those pages which are different from the one to be printed (and which include front and back covers), therefore, this tension is transmitted even to the page to be printed. As the result, same tension as the one added can be transmitted to the page to be printed. In the case of the manner of adding tension directly to the page which is to be printed, those members of a holder system by which both sides of the printed page adjacent to its seam are held may be driven in reverse directions along the seam line of the printed page. When it is needed that printing is applied to the page until near its seam, however, those areas of the printed page which are held and pulled by the members of the holder system may become smaller. It is therefore more advantageous that tension is added to the pages different from the one to be printed. It is also more advantageous to add tension to those pages (or front and back covers) of the booklet which are thicker. According to this embodiment of the present invention, tension is added to the front cover 1*a* of the booklet 1 in the conveying direction by the outlet rollers 6 and 7, thereby allowing the front cover 1*a* and the left page 1*b* to form a plane, as shown in FIGS. 3 and 4. Providing that a page following the left page 1*b* is to be printed, the left page 1*b* will be turned over to the position of the front cover 1*a* in FIG. 4. Even when tension is added to either the front cover 1*a* or the left page 1*b* turned over, however, the page following the left page 1*b* can be pressed against the platen on the conveying line with uniform force. Needless to say, tension may be added to both of the front cover 1*a* and the left page 1*b* turned over. When this manner is employed, the shear in printing can be reduced to the greatest extent, thereby enabling highly fine letters and images to be printed on the pages of the booklet. In a case where printing is applied to a previously printed page of the booklet at certain positions (or on lines and in frames) thereof, the page which is to be printed can be accurately positioned thereby preventing the printing from being shifted from these lines and frames.

The pulling force is added to the booklet 1 by the rollers 6 and 7 in the direction perpendicular to the seam line of the booklet 1, but it may act on the booklet in any direction if tension is added to the booklet in the direction. Further, the same functional merit can be achieved even when tension is added to the booklet using other systems except the rollers. Furthermore, in order to achieve the characteristic of the present embodiment which resides in that tension is added to optional pages to print images and others on the left page 1*b* of the booklet 1, the system employed by the present invention to adjust the pressing contact force may not be used but other conventional systems or methods may be used to add tension to the booklet.

The present embodiment is also characterized by the system for adjusting the pressing contact force of the roller 6 relative to the roller 7 through the actuator 14. Only the pressing contact force of the roller 6 relative to the roller 7 is changed in this case while keeping the rotating speed of the roller 6 certain. Let us think of a case where only the rotating speed of the roller 6 is changed while keeping the pressing contact force of the roller 6 relative to the roller 7 certain. When tension is to be controlled by the rotating speed of the roller 6, the control will become difficult and the page to be printed will not be pressed against the platen with uniform force because the direction in which the roller 6 is rotated must be made reverse, considering the rotating speed of the platen, as the left page of the booklet is wound further and further around the platen. Undesired tension will be added to the seam of the booklet to remarkably damage the booklet. When the pressing contact force of the roller 6 relative to the roller 7 is made so small as to create idling, as seen in the case of the present apparatus, this idling allows the left page of the booklet to slip between the rollers 6 and 7 only by a surplus of the tension even if the tension changes as the left page of the booklet is gradually wound around the platen. As the result, the tension which acts on the left page can be automatically adjusted to press the left page against the platen with uniform force.

When the pressing contact force of the roller 6 relative to the roller 7 is made large in the case of the above-described system, a drive force needed only to convey the booklet 1 can be created. When the pressing contact force of the roller 6 relative to the roller 7 is changed according to purposes, therefore, the booklet 1 can be moved variously. A drive means used only to convey the booklet 1 is made unnecessary thereby enabling the apparatus to be made smaller in size and simpler in structure.

The roller 7 of the above-described system can be rotated forward and backward by the motor 8. The booklet 1 can be thus moved toward the platen 17 so as to enable the printing process to be smoothly started. In addition, the roller 7 can be stopped to hold the booklet 1 not moved. As described above, therefore, the complicated process of turning over the pages of the booklet can be more easily attained by these controls of reversely rotating and stopping the roller 7.

The lower guide member 3*b* will now be described The guide member 3*b* is retreated downward during the printing process, as shown in FIGS. 3 and 4. When it is retreated downward in this manner, the plural pages of the booklet 1 including the back cover 1*c* (which will be referred to as untreated pages) hang due to their own weight in such a way that their movement is not disturbed. Providing that the printing process is started while keeping the guide member 3*b* under such a state as shown in FIG. 2, the untreated pages will be curved, covering the surface of the roller 20, while being kept between the guide member 3*b* and the roller 20. In other words, unnatural force will be added to this curved portion of the untreated pages. The front and back covers of a booklet are usually often made thicker than the other pages thereof to protect the booklet and the curved deformation will influence the life of the booklet. When the untreated pages of the booklet hang due to their own weight with their lower ends received by the guide member 3*b* as seen in the case of the present invention, however, they can be processed while being kept flat, thereby preventing the life of the booklet from being shortened. The lower guide member 3*b* may be horizontally retreated in the conveying direction as seen in the case of the upper guide member 2*b*.

According to the present invention, a part of the outer circumference of the platen 17 is cut away to form the flat face 22. This is intended to keep the back cover 1*c* opposed to the front cover 1*a* at the angle ($=\alpha°$), as shown in FIG. 5, when the left page 1*b* of the booklet 1 is completely wound around the platen 17. If the platen 17 has not the cut-away face 22, the back cover 1*c* of the booklet 1 is bent along the seam 1*d* onto the front cover 1*a* thereof in a direction reverse to the direction in which the booklet 1 or pages thereof is (are) opened or turned over. This deteriorates the rigidity of the seam 1*d*, thereby also adding bad influence to the life of the booklet 1. Particularly, sufficient tension is added to the front cover 1*a* of the booklet 1 in this apparatus of the present invention. When the platen 17 is a complete cylinder, therefore, the booklet 1 is fully bent along its seam 1*d* in the reverse direction. When the back cover 1*c* is bent along the seam 1*c* to oppose the front cover 1*a* at the angle, however, only the weight of the untreated pages acts on the seam 1*d* in the reverse direction. Needless to say, the shape of the platen can be variously changed to change the angle as desired.

Such downward retreat of the roller 20 as shown in FIGS. 4 and 5 is also intended to prevent the booklet 1 from being curved and the rigidity of the seam 1*d* from being deteriorated, as described above. When the platen 17 and the roller 20 are fixed by the arm 21, the positional relation (or interval) between the platen 17 and the roller 20 can be kept certain at all times. Even when any of the pages of the booklet 1 is turned over by the roller 20, therefore, this page can be accurately placed on the platen 17 at a predetermined position thereof by driving the roller 7.

Further, the guide plate 26 extending from the outer circumference of the platen 17 to that of the roller 20 serves as a conveying path for guiding the left page 1*b* of the booklet 1 from the roller 20 to the platen 17, so that the process of guiding the left page 1*b* to the platen 17 can be made extremely smooth. It is the most preferable that the guide plate 26 is aligned with the tangential lines of the platen 17 and of the roller 20, but it may be curved if it serves only as the conveying path. The left page 1*b* of the booklet 1 can be thus accurately held by the holder 23 without being caught or enfolded on the way of its being made ready for printing.

Furthermore, the left page 1*b* of the booklet 1 is face-contacted with the top of the guide plate 26 as shown in FIG. 3, and it can be thus stably held on the guide plate 26 until it begins to be wound, around the platen 17. This prevents unnatural force from being added only to the rear rim of the left page 1*b* (which is pressed, by the member 24).

A layout process will now be described referring to FIGS. 6 through 15.

FIG. 6 is a block diagram showing the arrangement of a process circuit which comprises a layout process circuit 31, a head drive circuit 32, the aformentioned printing head 15, a CPU 34 and lines for connecting these circuits. Output signals applied from a video camera or scanner (not shown), or image signals applied from a computer or through transmission lines are converted through a color converter circuit (not shown) to those signals which represent the amounts of ink used in response to the printing head, and they are applied to the layout process circuit 31 through an input line 35. Responsive to commands applied from the CPU 34 and information relating to the top and bottom of a booklet or page to be recorded, or (and) the direction of the printing head attached, the layout circuit 31 converts the image signals applied to inverted images, images by conversion or (and) vertical-to-traverse converted images, and supplies them to the head drive circuit 32. The head drive circuit 32 converts the converted image signals to pulse signals having widths for controlling energy (or printing energy) applied to each of exoergic resistors of the thermal (or recording) head 15, and it supplies them to the thermal head 15. This embodiment example of the present invention uses a thermal head of the line type in which 1536 pieces or pixels of the exoergic resistors are arranged to record 1536 pieces of data per line at the same time. To clarify the description, however, it is assumed in FIGS. 8 and 9 that one line comprises 10 pixels of data and that the number of data per page is 80 pixels.

Figure 7:
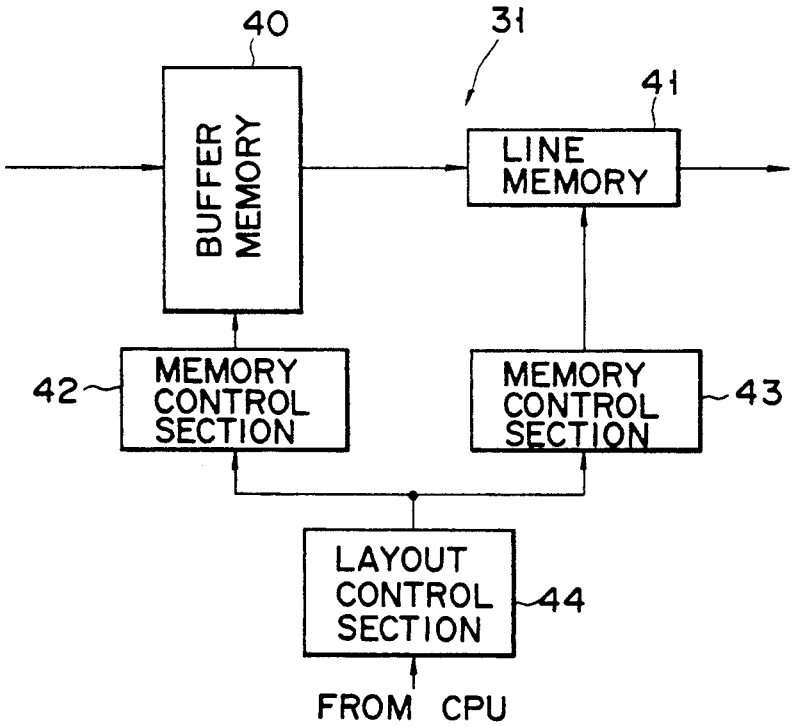
FIG. 7 is a block diagram showing a layout process.

FIG. 7 is a block diagram showing an arrangement of the layout process circuit 31. A buffer memory 40 has such a capacity that allows at least the image data of one color which is recorded by the printing head 15 shown in FIG. 6 to be stored one time, and a line memory 41 can store the image data of one line scanned by the printing head 15. A layout control section 44 controls memory control sections 42 and 43 responsive to those commands of the CPU 34 which tell whether or not any of the inverted image, image by inversion and vertical-to-traverse conversion to be processed is present. On memory control section 42 has a function of selecting line and column addresses in the buffer memory 40 through two address counters (not shown) to control both data writing into and data reading out of the buffer memory 40 as well as another function of carrying out vertical-to-traverse conversion. The other memory control section 43 controls both data writing into and data reading out of the line memory 41.

The inverted image processing operation of storing image signals applied in time series and synchronous with clock signals (not shown) into the buffer memory in the order of number 1 to number 80 as shown in FIG. 8 is carried out as follows:

The address of the line address counter at the memory control section 42 is set 1 and the address of the column address counter at this section is also set 1, and first data is written in the position of number 1. The column address is shifted by an increment of 2 and second data is written in the position of number 2 on line 1 and column 2. The writing of input data is then successively carried out in this manner while shifting the column address successively, and when tenth data is written in the position of number 10, the line address is shifted by an increment of 2 while the column address is set 1, and eleventh data is written in the position of number 11 on line 2 and column 1. This operation is repeated and when 80th data is written in the position of number 80, the writing process is finished.

The process of reading data out of the buffer memory 40 will now be described.

In a case where no inverted image is processed responsive to the command applied from the CPU 34 through the layout control section 44, reading is carried out in the order that data have been written into the buffer memory 40. The operation of the address counter at the memory control section 42 is therefore carried out in the same manner as in the writing process and data is read from the number 1 to the number 80 successively. In another case where the inverted image is processed responsive to the command applied from the CPU 34, the following operation is carried out. The line address is set 8 which represents the lowest line and the column address is set 1, and data of number 71 is read as first data. The line address is then shifted by an increment of 2 and data of number 72 on line 8 and column 2 is read as second data. Data are successively read in this manner while shifting the column address successively, and when tenth data is read out of the position of number 80, the line address is shifted to 7 and the column address is set 1. Data stored in the position of number 61 on line 7 and column 1 is thus read as eleventh data. When data stored in the position of number 10 is read as 80th data while repeating the above-described operation, the processing of the inverted image is finished.

Outputs of the buffer memory 40 are supplied to the line memory 41, where the image by mirror like conversion is processed while carrying out address control through the memory control section 43. The operation of processing the image by inversion is carried out as follows:

The address counter of the memory control section 43 is set 1 and first data which is an output of the buffer memory is written in the position of number 1 in FIG. 9. The address of the address counter is then shifted or increased to 2 and second data is written in the position of number 2 in FIG. 9. Data are successively written in this manner while increasing the address successively. When tenth data is written in the position of number 10, the writing of data per line is finished.

In a case where the image by inversion is not processed responsive to the command applied from the CPU 34 through the layout control section 44, the reading of data are carried out in the order that data have been written into the line memory 41. The operation of the address counter at the memory control section 43 is therefore carried out in the same manner as in the data writing operation and data are read from number 1 to number 10 successively. In another case where the image by inversion is processed responsive to the command applied from the CPU 34, the address of the address counter is set 10 and data in the position of number 10 is read as first data. The address is shifted or decreased to 9 and data in the position of number 9 is read as second data. Data are successively read in this manner while decreasing the address successively, and when tenth data is read out of the position of number 1, the processing of the image by mirror like conversion is finished.

The vertical-to-traverse converting process is carried out in such a way that information for carrying out this process is sent from the memory control section 42 to the buffer memory 40 to apply vertical-to-traverse conversion to data in memory 40.

The inverted image process of inverting image signals applied, the image-by-conversion process of inverting applied image signals from left to right, and the vertical-to-traverse converting process of converting the arrangement of column and line images can be achieved according to the above-described operations.

The line memory 41 for processing images by mirror like conversion is provided in addition to the buffer memory 40 in the above-described embodiment of the present invention. However, the line memory 41 is not necessarily needed but the function of processing image by inversion may be added to the buffer memory 40. The operation of the address counter at the memory control section 43 may be carried out by the column address counter at the memory control section 42 in this case. When arranged in this manner, the buffer memory 40 can carry out the inverted image and image-by-conversion processes and the vertical-to-traverse converting (90°-rotating) process at the same time, thereby reducing the number of hard components such as the line memory and counter used. When the buffer memory 40 is also used as an interface buffer to connect means, circuits and transmission paths, some of the memories can be made unnecessary.

Inverted images, images by inversion and vertical-to-traverse converted images are formed in the above-described embodiment of the present invention at the time when data is read out of the memory, but they may be formed at the time when data is written into the memory.

Figure 10:
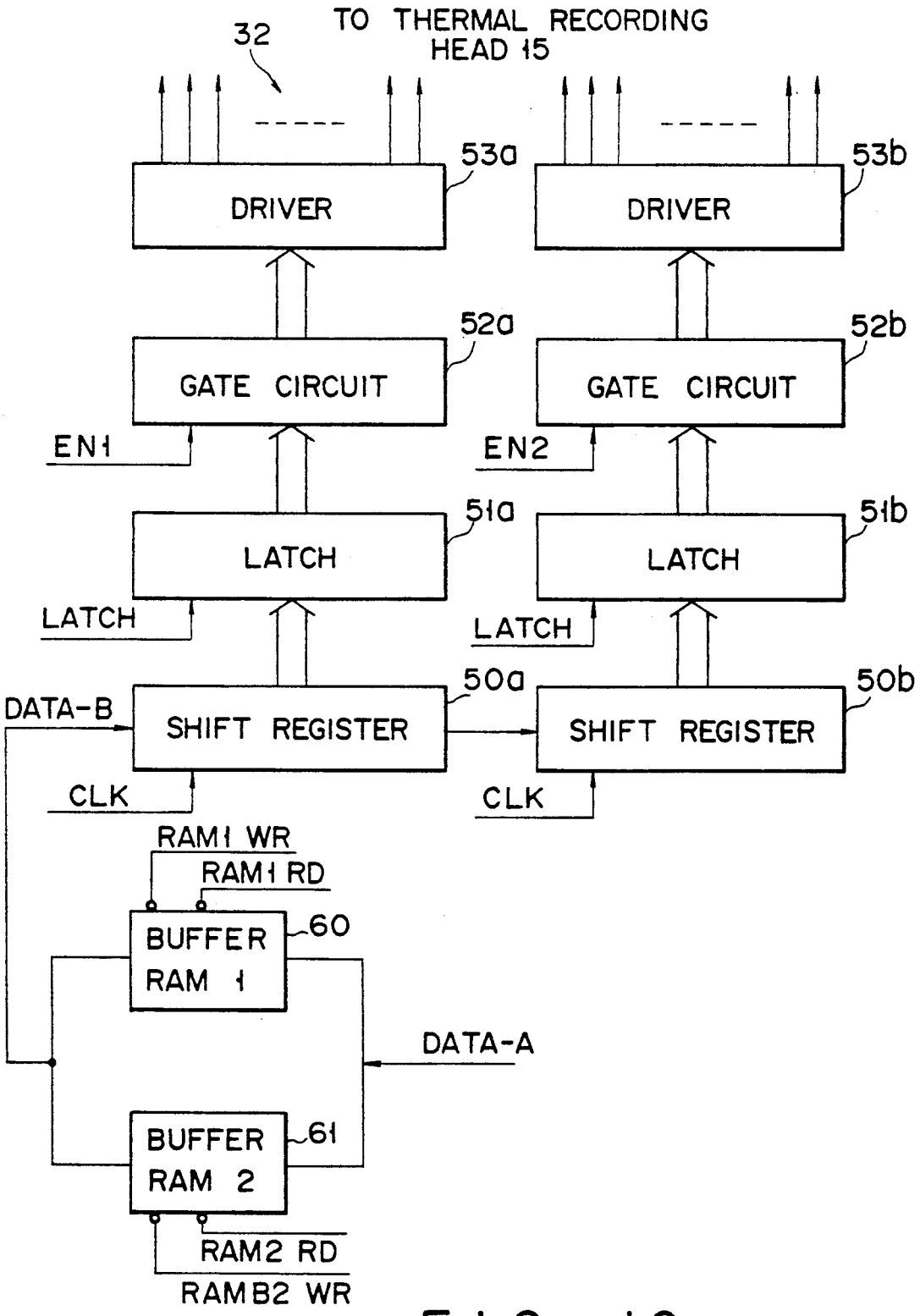
FIG. 10 is a block diagram showing a head drive circuit.
Figure 11A:
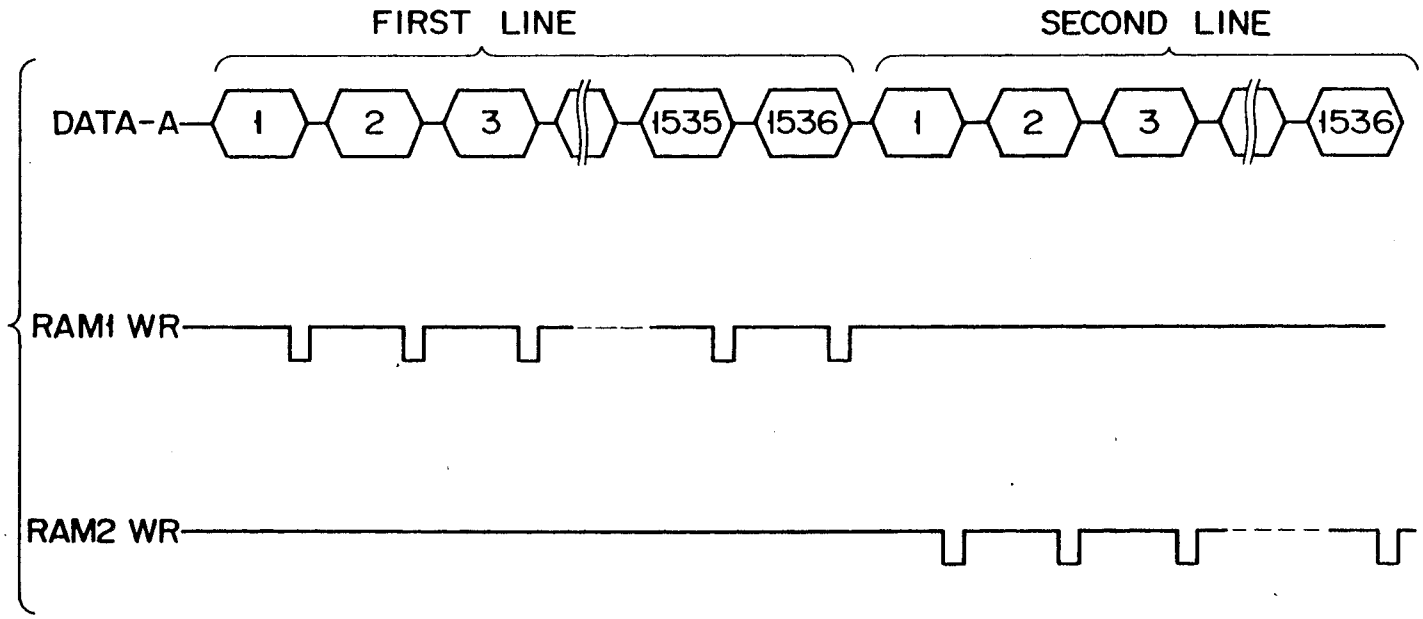
FIGS. 11A and 11B are signal timing charts intended to explain the head drive circuit shown in FIG. 10.
Figure 11B:
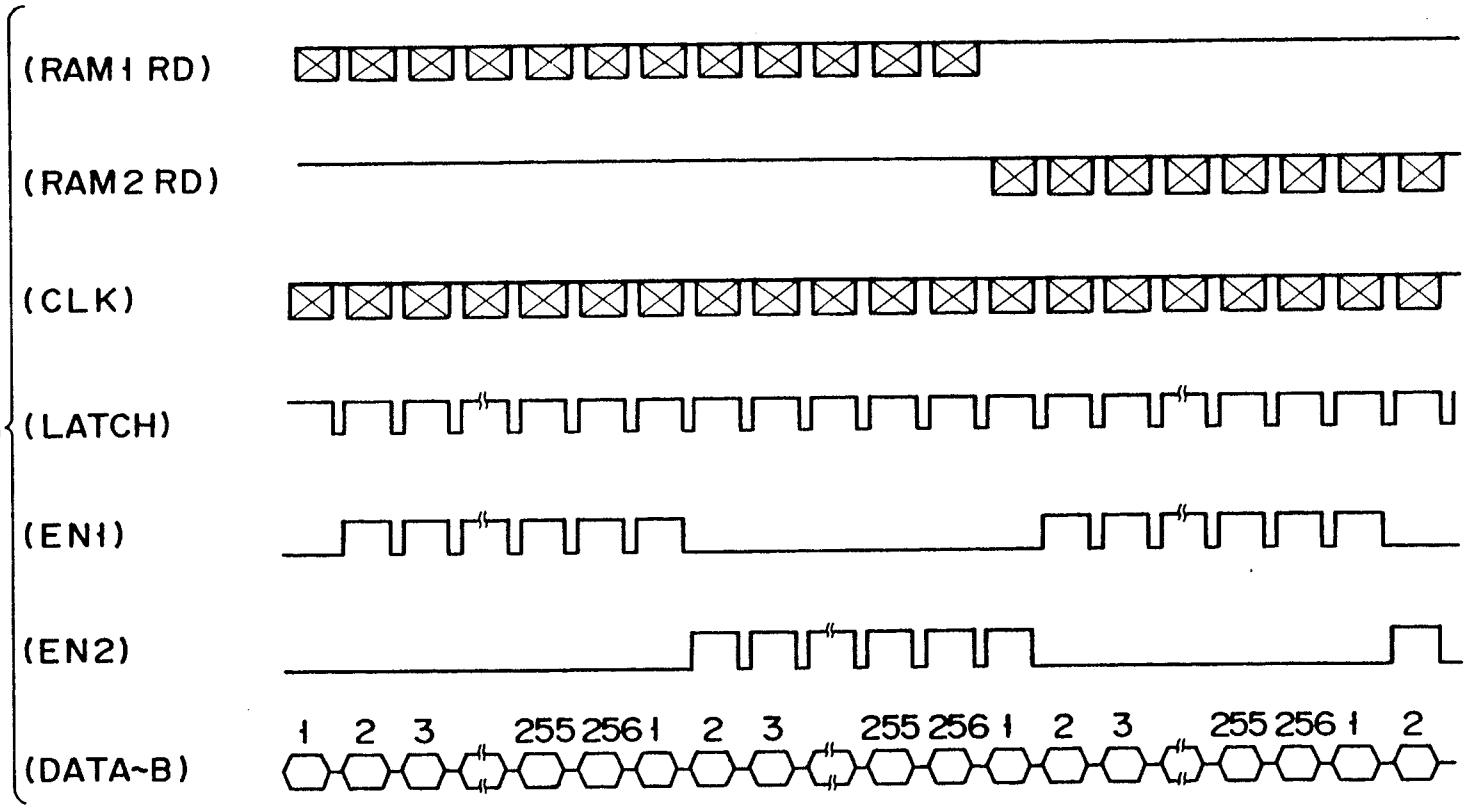

The head drive circuit 32 will now be described below. FIG. 10 is a block diagram showing the main portion of the head drive circuit 32, FIG. 11A a flow chart showing timings at which data is written into RAMs and FIG. 11B a flow chart showing signals which serve to process signals applied from the RAMs. The head drive circuit 32 is of the two-system type to drive the thermal head in two phases. Layout-processed image data signal (or DATA-A in FIG. 11A) which consists of 8 bits per a picture element and which corresponds to one line (the thermal head used in this apparatus has 1536 picture elements and data therefore corresponds to this number of picture elements) is written into two parallel RAMs 60 and 61, respectively. In the case of one RAM 60, writing timings are determined responsive to writing signal RAM1 WR and reading timings responsive to reading signal RAM1 RD. Similarly, writing timings are determined responsive to writing signal RAM2 WR and reading timings responsive to reading signal RAM2 RD in the case of the other RAM 61. An output signal applied from these RAMs to correspond to one line includes 1536 pieces of binary data, 256 pieces (or 8 bits) of which correspond to one picture element, as shown by DATA-B in FIG. 11B, and it is applied to a shift registor 50*a*. Writing time relative to RAM is needed to correspond to 1536 picture elements. This apparatus of the present invention therefore uses two RAMs so as to process these picture elements in real time. Namely, writing is carried out relative to one RAM while reading data out of the other RAM. First data of those 256 data which are shown by DATA-B is transferred by 1536 pieces at first to the shift registor 50*a*. This signal is also sent from the shift registor 50*a* to another shift registor 50*b* and input signals applied to these both registors are transferred at the same time responsive to clock signals CLK (1536 pieces of clock signals are represented by one box in FIG. 11B). Outputs applied from these registors 50*a* and 50*b* are inputted in parallel to latch circuits 51*a* and 51*b* and latch-processed therein and sent to gate circuits 52*a* and 52*b*. Enable signals EN1 and EN2 each of which corresponds to a half line are alternately supplied to the gate circuits 52*a* and 52*b*. Outputs of these gate circuits 52*a* and 52*b* are sent to the exoergic resistors of each phase in the thermal head 15 through drivers 53*a* and 53*b* and heat transfer printing is thus carried out. When 256th data of the printing signal applied from one RAM is sent through one gate circuit 52*a* by enable signal EN1 and half printing of the two-phase drive is finished, same data applied from the same RAM is now sent through the other gate circuit 52*b* by enable signal EN2 and printing similar to the above is carried out. Printing which corresponds to one line (or 1536 picture elements) of the thermal head is thus finished.

This apparatus of the present invention employs the heat transfer printing or thermal printing which uses subliming dyestuff ink. According to this type of recording, that amount of dyestuff ink which is about proportional to the quantity of heat of the thermal head is recorded and this is suitable for full color recording. As described above about the system of the thermal head, this thermal head is intended to form recorded images on a page while pressing the page against the platen roller through the ink ribbon and selectively applying current to the exoergic resistors arranged in lines to heat and sublime the dyestuff ink.

Figure 12:
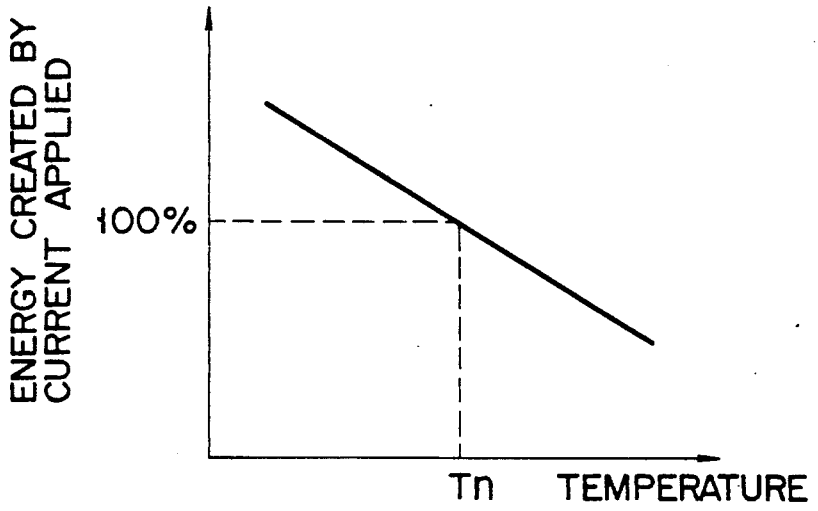
FIG. 12 is a graph showing the relation of temperature relative to energy injected.
Figure 13:
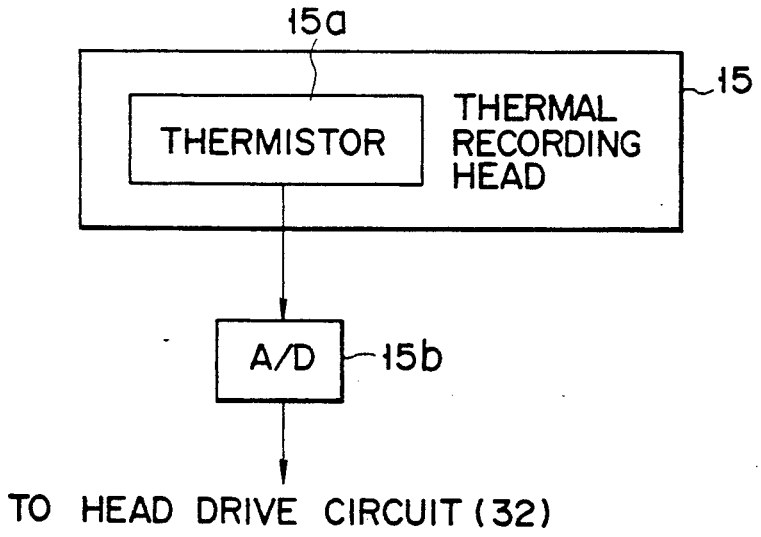
FIG. 13 shows a temperature detector section in a thermal head.
Figure 14:
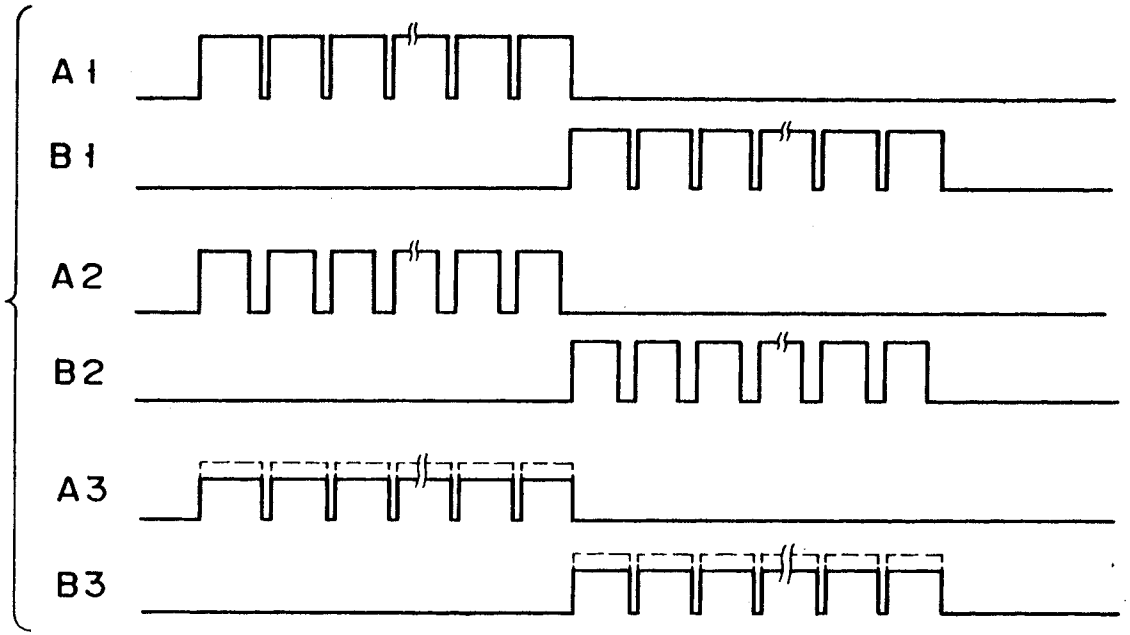
FIG. 14 is a view showing waveforms representing output voltages of drivers.

According to this apparatus of the present invention, temperature data of the thermal head 15 is fed back to the head drive circuit 32. This is intended to appropriately control the amount of energy created by current applied responsive to temperatures of the thermal head itself detected, because the amount of ink transferred becomes different, depending upon heat stored in the thermal head itself and environmental temperature, even when the amount of energy created by current applied is kept same. Providing that the amount of this current energy is 100%, as shown in FIG. 12, when temperature is normal (or Tn), a certain amount of ink can be transferred onto the pate at all times regardless of the state of heat stored in the thermal head by using the above-mentioned control to reduce the amount of the current energy as temperature rises but to increase it as temperature falls. Temperature detection of the thermal head is made in such a manner that a thermistor 15*a* for temperature detection is connected to the thermal head 15 and that output of this thermistor is applied to the head drive circuit 32 through an A/D converter 15*b*, as shown in FIG. 13. In order to reduce the current energy applied to the thermal head, it may be arranged that pulse widths of enable signals EN1 and EN2 are supplied to the gate circuits 52*a* and 52*b* shown in FIG. 10 are reduced to those A1 and B2 shown in FIG. 14 or that amplitude values of output voltages of the drivers 53*a* and 53*b* are reduced from A1 and B1 to A3 and B3 in FIG. 14.

Images recorded by the subliming dyestuff ink can be used as they are, but it is preferable from the viewpoint of protecting the recorded images and preventing the printing ink from fading that the images are covered by a film of transparent plastics. The usual laminating process can be conducted in this case, using the heat sealing and stitching manners.

Figure 15B:
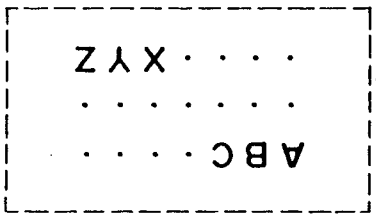
FIGS. 15A and 15B are views showing how the booklet is printed.
Figure 15A:
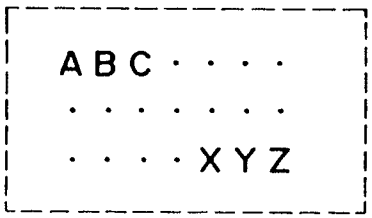
Figure 15:
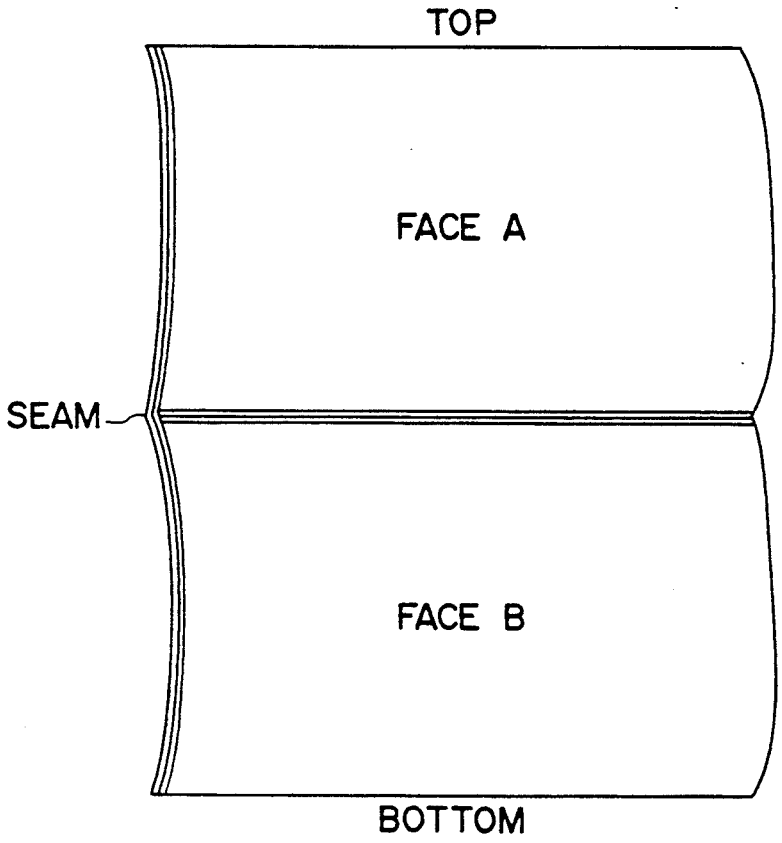
FIG. 15 is a view showing a booklet open.

FIG. 15 shows a booklet open. The booklet such as the passbook often has a top and a bottom, as shown in FIG. 15. When the "top" of the booklet is directed upward while directing its "bottom" downward, images such as recorded letters, pictures and symbols can be viewed as they must be. In a case where images shown in FIG. 15A are to be recorded on a predetermined page from one end of the page to the seam thereof.(or from the seam of the page to one end thereof), the printing is conducted on the page from the "top" of the page to the "bottom" thereof or from the "bottom" of the page to the "top" thereof, depending upon pages on which images are to be recorded. In a case where the booklet is inserted into the apparatus with the "bottom" thereof brought ahead and images are printed on a face A of the booklet in FIG. 15, neither of the inverted image and image-by-inversion processes is conducted. In another case where the booklet is inserted into the apparatus with the "top" thereof brought ahead and images are recorded on a face B of the booklet in FIG. 15, the inverted image and image-by-inversion processes are conducted and the images are arranged and recorded, as shown in FIG. 15B, to enable correct printing to be attained. The printing in this case is conducted according to the following manners.

The printing position of the booklet is set to the last dot column of the last line (one line consists of 16 or 32 dots) to be printed and data which corresponds to the last dot column of the last line (or line on which the letters "XYZ - - - " are inverted) is printed on the printing position of the booklet thus set. The booklet is then successively advanced by one dot and printing is conducted until it comes to the first dot column of the first line (first manner).

When the technique of conveying booklets as disclosed in the Japanese Patent Publication Sho 61-24750 is instead applied to the present invention, the following manner can be employed.

The first line on a page of the booklet to be printed is brought to the position of the head 15 and data which corresponds to the last line (or line on which the letters "ABC - - - " are inverted) shown in FIG. 15B is printed at first on the first line on the page of the booklet. The booklet is then retreated by one line and data is printed on a next line. The printing is successively conducted on the page of the booklet in this manner while successively retreating the booklet by one line (second manner).

The above-mentioned two printing manners create the same result in the end. According to the first manner, the position of the booklet must be set in such a way that it is calculated how many lines are to be printed and that the number of pulses which correspond to the number of these line to be printed is applied to the platen drive motor. The second manner needs a means for detecting the line to be printed from now (or position of the last line printed on the booklet till then). This detector means is also needed in the case of the first manner.

It is preferable that a means for detecting whether the booklet is inserted into the apparatus with the "top" or "bottom" thereof brought ahead (the detector means comprising a light-emitting element 100*a* and a light-receiving element 100*b* for receiving light emitted from the light-emitting element 100*a* and passed through the booklet which is conveyed through the conveying path, as shown in FIG. 1, for example) is added to the apparatus of the present invention. This means can be realized by the following manners, for example.

The first manner comprises previously printing a mark at a predetermined position of the booklet (or at a rim portion of the opened booklet or at a margin of the printed area thereof), providing a detector (which comprises a combination of an element for emitting light onto the margin of the booklet and another element for receiving the light reflected by or passed through the margin of the booklet to detect whether or not the booklet is printed) on the conveying path in the apparatus, and reading the mark on the booklet by the detector to detect the direction of the booklet depending upon whether or not the mark is on the booklet. When the mark can be detected on the booklet for example, it can be found that the booklet is inserted into the apparatus with the "top" thereof brought ahead. If not, it can be found that the "bottom" of the booklet is inserted ahead into the apparatus.

The second manner comprises referring to previously known information which tells that line numbers are in frames at the left end of the booklet such as the passbook, and finding which end of the passbook is inserted ahead into the apparatus depending upon whether the frames are at the left or right end of the passbook.

Figures 17A, 17B:
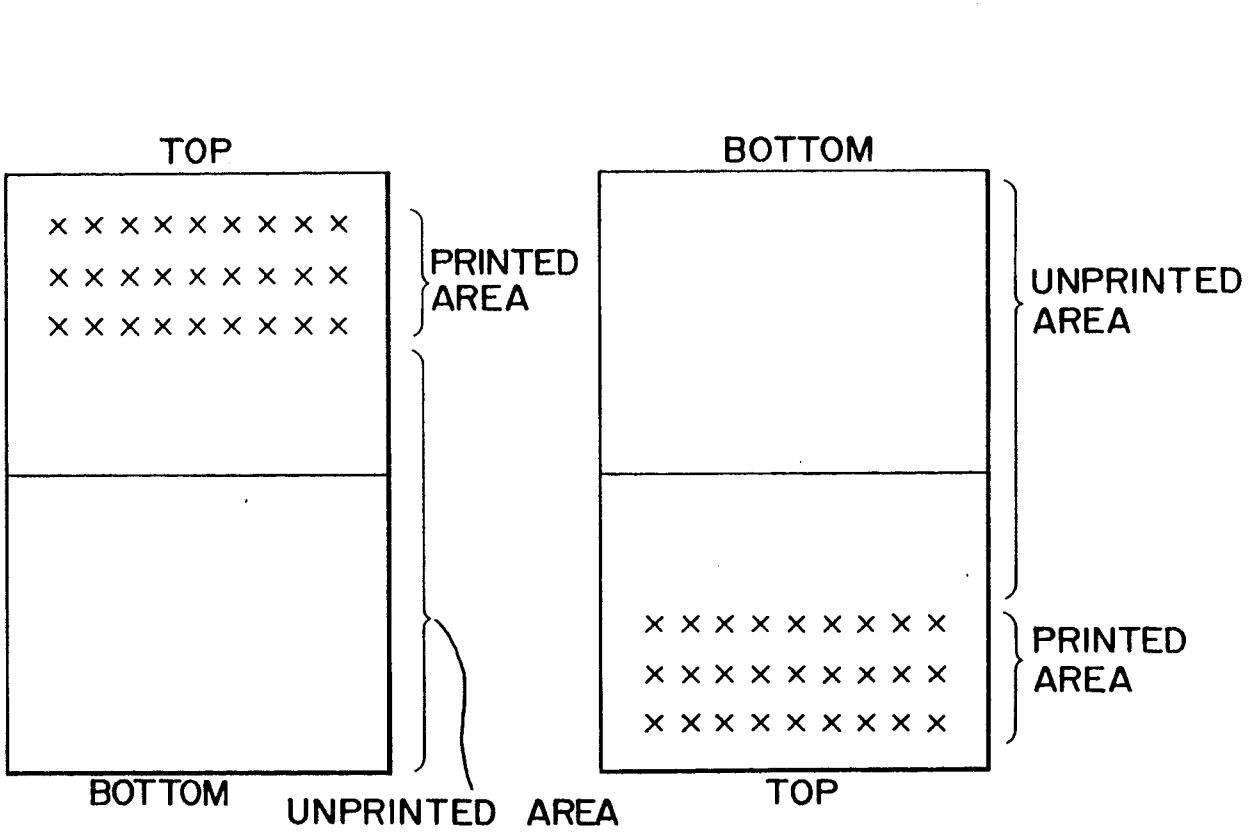
FIGS. 17A and 17B are views showing the booklet open to explain the direction in which the booklet is printed.

The third manner uses the technique disclosed in the Japanese Patent Disclosure Sho 56-44835. When every one of all lines on a page of the booklet to be printed is confirmed relating to whether or not the printing is conducted on it, this confirmation is successively started from the first line at that front side of the opened booklet which is inserted into the apparatus. Namely, it can be detected which side of the opened booklet is inserted ahead into the apparatus, depending upon whether the confirmation is shifted from printed lines to unprinted ones or vice versa, as shown in FIG. 17A or 17B. According to this third manner, any of the pages of the booklet can be referred to after one of its adjacent pages is turned over in a case where all lines on this adjacent page are left not printed. The direction in which the booklet is inserted into the apparatus can be found from the relation of the printed page of the booklet relative to the unprinted page thereof. The inverted images and images by inversion can be layout-processed on the basis of this confirmed information. A certain layout process may be naturally conducted relative to these images according to the needs of your user.

In a case where the opened booklet is inserted into the apparatus with its traverse side brought ahead in the case of this example of the present invention, correct printing can be conducted, using the vertical-to-traverse converting process.

In order to record images on a page of the booklet until near the seam thereof, it is advantageous that the direction of the thermal head attached is arranged as shown in FIGS. 1 through 5. More specifically, it is arranged that record scanning is directed inward from the edge side of the thermal head of the edge type in which the exoergic resistors are concentrated on the edge of the thermal head. In the case of the usual facsimile and the like, however, the thermal head is arranged in such a way that record scanning is directed outward from the center of the head to the edge thereof. In a case where the cheap and usually available thermal head used in the facsimile and the like is applied to this example of the present invention, it is needed that order and direction in which data of one line is inputted is made reverse to those in the case of the facsimile. In a case where images are recorded on the face A in FIG. 15 by this example of the present invention, using the commonly available thermal head as it is, therefore, the image-by-inversion process is needed. In another case where images are recorded on the face B in FIG. 15 in the same manner, the inverted image process is needed. All or some pages of the booklet or a part of a predetermined page thereof is (are) made like a transparent sheet or sheets, depending upon the field in which the booklet or some pages of the booklet are used. When images are recorded on that page the whole or a part of which is made by a transparent sheet, images are recorded on one face of the transparent sheet page of the booklet. In a case where the transparent sheet page of the booklet is turned over and the images recorded on the one face of this transparent sheet page are to be viewed from the other face thereof, the face A on which the images have been recorded is located at the position of the face B when the face B is viewed. Therefore, the inverted image process is needed in the case of the images recorded on the face A in FIG. 15 and the image-by-inversion process is needed in the case of the images recorded on the face B in FIG. 15. According to this example of the present invention, both of the inverted image and image-by-inversion processes are needed in the case of the images recorded on the face A but neither of these processes is needed in the case of the images recorded on the face B because of the direction in which the thermal head is attached. FIG. 16 shows these relations in a table.

Because letters are mainly used and printed in the case of the passbook, the term "printing" is used. However, matters to be recorded (or printed) are not limited in the present invention. Therefore, image information including the letters can also be recorded. If it is supposed in this case that image printing can be achieved by the common printer, it can be easily imagined that the image information printing can be realized according to the process of printing letters on the passbook.

It is not defined in the present invention that the booklet (or passbook) must be inserted into the apparatus while keeping it open. Therefore, it may be arranged that the closed booklet is inserted into the apparatus, that pages of the booklet are turned over until a predetermined page thereof on which images are to be recorded is found, and that the images are then recorded on this predetermined page of the booklet. The process of turning over pages of the booklet can be made apparent from the above.

Although description has been made relating to the image printing on "the rear side page" of those of the open booklet inserted into the apparatus, the image printing can be made on the front side page of the booklet when the inlet rollers 4 and 5 are located on the right side of the outlet rollers 6 and 7 or at the right ends of the guide members 2*c* and 3*c* and the booklet is inserted into the apparatus from the right side of the guide members 2*c* and 3*c* in FIG. 1.

The common passbook and note whose pages are completely bound by and those booklets whose pages are bound by so as to allow each of the pages to be easily detached from the booklets can be used in the present invention.

As described above the apparatus for printing images on booklets according to the present invention includes means for processing inverted images and images by inversion. Therefore, image printing can be achieved, as desired, by a single unit of the printing apparatus, no matter how the booklet may be inserted into the apparatus with its top or bottom brought ahead. Further, image printing in full color can be made on the page of the booklet until the images recorded comes near to the seam of the booklet, without adding any damage to this seam.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An apparatus for printing images on booklets having pages comprising:

means for printing images on the pages of the booklet;

means for automatically conveying only one page for all pages of the booklet to the printing means while keeping the other pages of the booklet open;

means for determining whether or not the layout of the images recorded is changed when the page of the booklet is inserted into the apparatus with its top or bottom fed first, and layout processing means for causing the printing means to record the images on the pages of the booklet responsive to the determination thus made.

2. The apparatus according to claim 1, wherein said layout processing means includes first memory means for storing image data which corresponds to at least one page, second memory means for storing image data which corresponds to at least one line, means for processing the image data stored in the first memory means into inverted images, and means for processing the image data stored in the second memory means into images by inversion.

3. An apparatus for printing images on opened booklets having pages comprising:

a head for printing the images on the pages of the booklet;

first and second means for conveying pages of the opened booklet to the printing head, said printing head being located between the first and second conveying means;

a rotatable platen having an outer circumference opposed to the printing head and located between said conveying means;

means for automatically guiding only one page for all pages of the opened booklet to the outer circumference of the platen;

means for temporarily fixing a free end of the one page to the outer circumference of the platen; and means for causing the second conveying means to hold another page of the booklet but allow it to slip in the second conveying means when the free end of the one page is temporarily fixed onto the outer circumference of the platen and adding tension to the other page of the booklet as the platen is rotated.

4. The apparatus according to claim 3, further including means for turning over the one page of the booklet.

5. An apparatus for printing images on booklets having pages comprising:

means for printing images on the pages of the booklet;

means for automatically transporting only one page for all pages of the booklet in an open state to the printing means;

means for detecting on the opened booklet to be transported to the printing means whether the top or bottom is transported ahead; and layout processing means for changing the layout of the recorded images by means of at least one of an inverted image process and an image-by inversion process, based on whether the booklet on which the images are to be recorded is transported to the printing means with its top or bottom fed first and for controlling printing the images on the pages of the booklet through the printing means.

6. A process for printing images on booklets including a transparent page having one viewing face and another recording face comprising the steps of:

providing means for printing images on the recording face of the transparent page of the booklet;

transporting the recording face of the transparent page of the booklet to the printing means;

detecting on the booklet to be transported to the printing means whether the top or bottom of the booklet is transported first; and changing the layout of the images by means of one of an inverted image process and an image-by inversion process, based on whether the booklet on which the images are to be recorded is inserted into the apparatus with its top or bottom fed first and controlling printing of the images on the recording face of the transparent page of the booklet transported through the printing means.

7. An apparatus for printing images including at least one line section extending to one direction on a booklet having pages comprising:

means for printing the line section images on the pages of the booklet toward the left side from the right side;

means for automatically transporting only one page for all pages of the booklet in an open state to the printing means;

means for detecting on the opened booklet to be transported to the printing means whether the top or bottom is transported ahead; and layout processing means for changing the layout of the recorded images by means of one of an inverted image process and an image-by inversion process, based on whether the booklet on which the images are to be recorded is inserted into the apparatus with its top or bottom fed first and for controlling printing the images on the pages of the booklet through the printing means.

8. An apparatus for printing images on pages of a booklet comprising:

a head for printing the images on the pages of the booklet;

a rotatable platen having an outer circumference opposed to the printing head;

mean for conveying an opened booklet near the platen;

means, for all pages, for separating only one page from the other pages, guiding only the separated one page of the opened booklet onto an outer circumference of the platen and preventing the other pages from being guided onto the outer circumference; and means for printing the images on the separated on page.

9. The apparatus according to claim 8 wherein said separating means includes means for selectively moving the separated page to return to an original position against the other pages and to turn over other further pages of the booklet.

* * * * *